US010152911B2

(12) United States Patent
Tsai et al.

(10) Patent No.: US 10,152,911 B2
(45) Date of Patent: Dec. 11, 2018

(54) POWER SUPPLY CIRCUIT AND DRIVING METHOD FOR DISPLAY PANEL

(71) Applicant: AU Optronics Corporation, Hsin-Chu (TW)

(72) Inventors: Wei-Chin Tsai, Hsin-Chu (TW); Chun-Kuei Wen, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 63 days.

(21) Appl. No.: 15/351,959

(22) Filed: Nov. 15, 2016

(65) Prior Publication Data

US 2017/0162106 A1 Jun. 8, 2017

(30) Foreign Application Priority Data

Dec. 2, 2015 (TW) ..... 104140369 A

(51) Int. Cl.
*G09G 3/20* (2006.01)
*G09G 3/36* (2006.01)

(52) U.S. Cl.
CPC ..... *G09G 3/2092* (2013.01); *G09G 3/3696* (2013.01); *G09G 2300/0871* (2013.01); *G09G 2310/061* (2013.01); *G09G 2330/00* (2013.01); *G09G 2330/028* (2013.01)

(58) Field of Classification Search
CPC ..... G09G 3/2092
See application file for complete search history.

(56) References Cited

U.S. PATENT DOCUMENTS

2006/0028419 A1* 2/2006 Lee ..... G09G 3/3648 345/98
2008/0129903 A1* 6/2008 Hong ..... G09G 3/3648 349/36

FOREIGN PATENT DOCUMENTS

TW I391904 4/2013

* cited by examiner

*Primary Examiner* — Alexander Eisen
*Assistant Examiner* — Cory A Almeida
(74) *Attorney, Agent, or Firm* — WPAT, PC

(57) ABSTRACT

A power supply circuit includes a comparison circuit, a preset value setting circuit, a reset detecting circuit and a reset signal generating circuit. The comparison circuit compares a first and second voltage to output a comparing result. The first and second voltages correspond to a first and second preset value, respectively. When the comparison result shows that the second voltage is greater than the first voltage, the preset value setting circuit outputs the second preset value; otherwise it outputs a third preset value, which is greater than the first preset value. The reset detecting circuit determines whether the operation voltage of the power supply circuit drops to the preset value outputted by the preset value setting circuit, and outputs a control signal accordingly. The reset signal generating circuit determines whether to output a reset signal for resetting gate lines in a display panel based on the control signal.

8 Claims, 4 Drawing Sheets

POWER SUPPLY CIRCUIT AND DRIVING METHOD FOR DISPLAY PANEL

CROSS-REFERENCE TO RELATED APPLICATIONS

This application claims priority to Taiwanese Patent Application No. 104,140,369 filed in the Taiwanese Patent Office on Dec. 2, 2015, the entire content of which is incorporated herein by reference.

BACKGROUND OF THE INVENTION

The present disclosure relates to a power supply circuit, and more specifically to a power supply circuit that can reset gate lines in a display panel, and to a corresponding driving method of this display panel.

When a display device enters a power-off status, residual electric charges remain in pixels of the display panel after power-off, and these residual electric charges stay in the pixels until the next power on, resulting in an abnormal display (flickering) when the display device powers on again. In order to address this problem, a conventional power supply circuit outputs a reset signal to a gate drive circuit in the display device before an operating voltage drops to 0 V, such that the gate drive circuit simultaneously drives all gate lines in the display panel based on the reset signal, so that the residual electric charges in all pixels are released.

FIG. 1 is a block diagram of a conventional display device. As shown in FIG. 1, a display device 100 includes a power supply circuit 101, a gate drive circuit 102, and a display panel 103. The power supply circuit 101 receives an operating voltage VCC, and accordingly outputs a high voltage level VGH and a low voltage level VGL (the low voltage level is lower than 0 V) to the gate drive circuit 102, such that the gate drive circuit 102 can generate a gate pulse based on the high voltage level VGH and the low voltage level VGL. When the display device 100 powers off, the power supply circuit 101 outputs a reset signal XON to the gate drive circuit 102 before the operating voltage VCC drops to 0 V, in order to control the gate drive circuit 102 to generate multiple gate pulses through the operation of an internal shift register SR and a level shifter LS, and thus simultaneously driving gate lines G1-Gn, and further releasing residual electric charges in all pixels.

However, when the display device 100 powers off, both the potentials of the operating voltage VCC and the high voltage level VGH drop to 0 V, and the low voltage level VGL restores from a negative voltage to 0 V. When the operating voltage VCC drops below a critical level, the level shifter LS in the gate drive circuit 102 is unable to operate normally, the gate drive circuit 102 is unable to output sufficient gate pulses in response to the reset signal XON to simultaneously drive the gate lines G1-Gn, and thus the residual electric charges in each pixel of the display panel 103 are not released as expected.

BRIEF SUMMARY OF THE INVENTION

The present disclosure discloses a method of driving a power supply circuit to a display device that can reset all gate lines before a total loss of power. The present disclosure provides a power supply circuit with a comparison circuit, a preset value setting circuit, a reset detecting circuit, and a reset signal generating circuit.

The comparison circuit is configured to compare a first voltage with a second voltage and output a comparison result. The first voltage corresponds to a first preset value which determines a first operating voltage threshold below which the power supply circuit stops outputting a high voltage level and a low voltage level to a gate drive circuit. Separately, the second voltage corresponds to a second preset value which determines a second operating voltage threshold below which the power supply circuit outputs a reset signal.

The preset value setting circuit outputs a reset threshold based on the comparison result. When the comparison result shows that the first voltage is greater than the second voltage, the preset value setting circuit outputs the third preset value as a reset threshold, with the third preset value being greater than the first preset value. Otherwise, when the comparison result shows that the first voltage is less than the second voltage, the reset threshold is set to the second voltage.

The reset detecting circuit is configured to output a control signal when the operating voltage drops to the reset threshold.

The reset signal generating circuit outputs the reset signal to the gate drive circuit according to the control signal. This circuit drives a plurality of gate lines in a display panel in response to said reset signal The present disclosure further discloses a driving method for a display panel, suitable for display panels having multiple gate lines. The driving method for a display panel disclosed in the present disclosure includes the following steps:

- Comparing a first voltage with a second voltage and outputting a comparison result. The first voltage corresponds to a first preset value determining a first operating voltage threshold below which a power supply circuit stops outputting a high voltage level and a low voltage level to a gate drive circuit. Separately, the second voltage corresponds to a second preset value determining a second operating voltage threshold below which said power supply unit outputs a reset signal.
- Deciding whether to output the second preset value or a third preset value, which is greater than the first preset value, as a reset threshold based on the comparison result.
- Outputting the third preset value as the reset threshold when the comparison result shows that the first voltage is greater than the second voltage.
- Controlling the power supply circuit to output the reset signal to the gate drive circuit when the operating voltage is not greater than said reset threshold.
- driving multiple gate lines simultaneously when said gate drive circuit receives said reset signal.

Because the power supply circuit of the present disclosure uses the comparison circuit to compare the first voltage and the second voltage (corresponding to the first preset value and the second preset value) in advance, when the first voltage is greater than the second voltage, the preset value setting circuit can be used to adjust the second preset value to the third preset value, which is greater than the first preset value. In this way, when the display device powers off, the power supply circuit can output a reset signal to control the gate drive circuit to generate the gate pulses needed in advance when the operating voltage drops to the third preset value. Moreover, because a voltage difference between the operating voltage and the low voltage level at this time still enables normal operation of a level shifter in the gate drive circuit, the gate drive circuit can generate the needed gate pulses without a problem so that the gate lines in the display panel can be reset simultaneously.

DETAILED DESCRIPTION OF THE INVENTION

Figure 1:
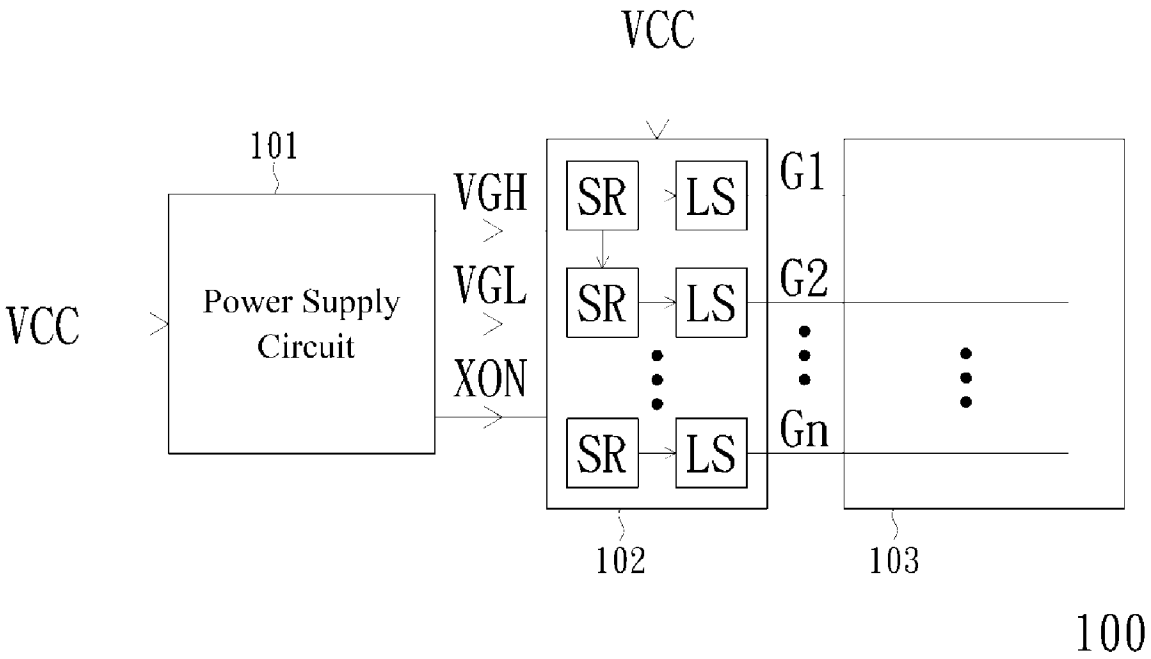
FIG. 1 is a block diagram of a conventional display device.
Figure 2:
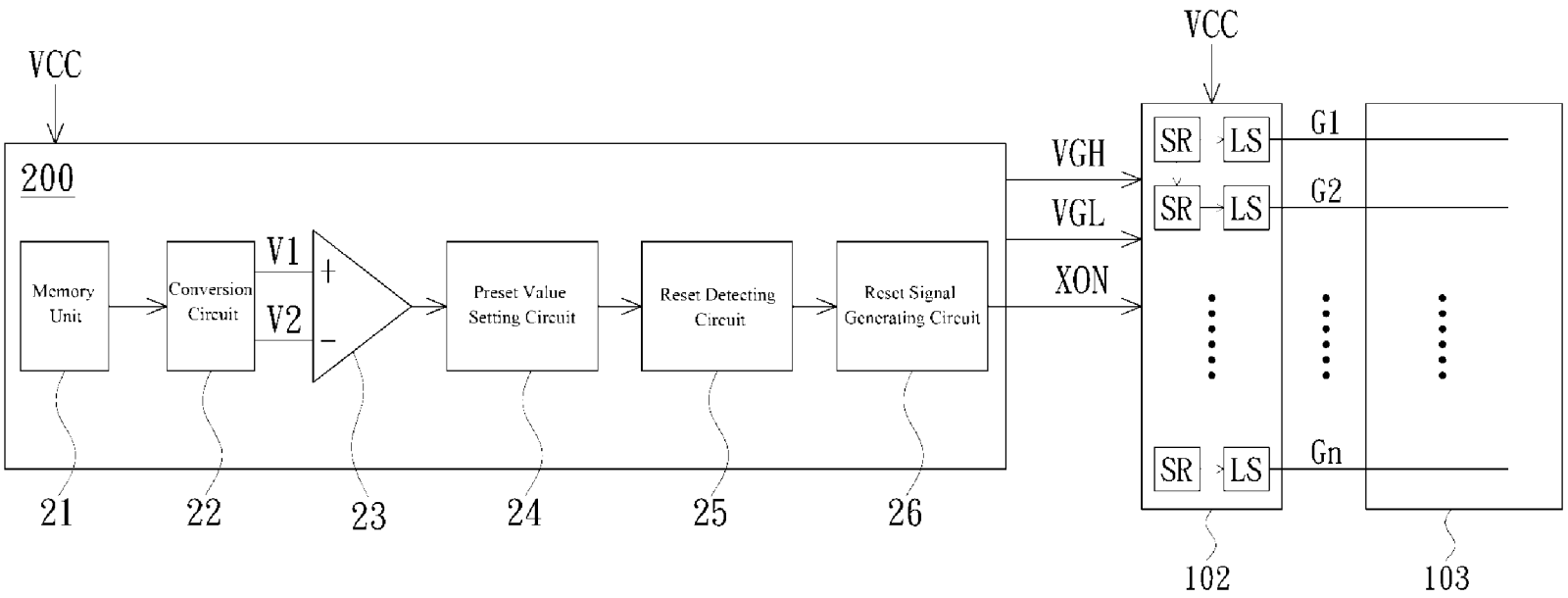
FIG. 2 is a block diagram of a display device using a power supply circuit according to one embodiment of the present disclosure.

FIG. 2 is a block diagram of a display device using a power supply circuit according to one embodiment of the present disclosure. In FIG. 2 and FIG. 1, the same numerals indicate same elements or signals. As shown in FIG. 2, the power supply circuit 200 is adapted to output a reset signal XON, a high voltage level VGH, and a low voltage level VGL to a gate drive circuit 102, to enable the gate drive circuit 102 to simultaneously drive multiple gate lines G1-Gn in a display panel 103 upon receipt of the reset signal XON. The high voltage level VGH and low voltage level VGL are respectively used as the high level and low level of the gate pulses outputted by the gate drive circuit 102. Besides a comparison circuit 23, a preset value setting circuit 24, a reset detecting circuit 25, and a reset signal generating circuit 26, the power supply circuit 200 in the present embodiment further includes a memory unit 21 and a conversion circuit 22.

The comparison circuit 23 is configured to compare a first voltage V1 with a second voltage V2 and output a comparison result, wherein the first voltage V1 and the second voltage V2 correspond to a first preset value and a second preset value respectively.

The first preset value represents the voltage at which to stop outputting the driving voltages to the display. Specifically, when an operating voltage VCC of the power supply circuit 200 drops to the first preset value, the power supply circuit 200 stops outputting the high voltage level VGH and low voltage level VGL to the gate drive circuit 102 (for example, setting both the high voltage level VGH and low voltage level VGL as 0 V).

Separately, the second preset value represents the voltage at which to reset the display by driving all gate lines. Specifically, when the operating voltage VCC drops to the second preset value, the power supply circuit 200 outputs the reset signal XON.

The first preset value and second preset value are stored in the memory unit 21. The conversion circuit 22 is configured to read the first preset value and second preset value stored in the memory unit 21, and to convert the first preset value and second preset value to the voltages V1 and V2 respectively so that the comparison circuit 23 can perform a comparison. In this embodiment, although the power supply circuit 200 uses the memory unit 21 and the conversion circuit 22 to perform operations, the present disclosure is not limited thereto. Those skilled in the art would appreciate that the memory unit 21 and the conversion circuit 22 can be optionally adopted depending on the actual designs of the power supply circuit 200. For example, the voltages V1 and V2 may be supplied externally to the power supply circuit 200, or be directly generated by other internal circuits of the power supply circuit 200.

Referring to FIG. 2, the preset value setting circuit 24 is configured to decide, based on the comparison result of the comparison circuit 23, whether to output the second preset value or a third preset value as a reset threshold. When the comparison result shows that the first voltage V1 is greater than the second voltage V2, the preset value setting circuit 24 outputs the third preset value, which is greater than the first preset value, as the reset threshold; otherwise, when the comparison result shows that the first voltage V1 is less than the second voltage V2, the preset value setting circuit 24 outputs the second preset value as the reset threshold. In the present embodiment, the preset value setting circuit 24 stores a look-up table, and the third preset value is recorded in the look-up table. Therefore, when the comparison result shows that the first voltage V1 is greater than the second voltage V2, the preset value setting circuit 24 may locate the third preset value from the look-up table. The reset detecting circuit 25 is configured to determine whether the operating voltage VCC drops to the reset threshold outputted by the preset value setting circuit 24 (which may be the second preset value or the third preset value), and to decide whether to output a control signal to the reset signal generating circuit 26 accordingly. The reset signal generating circuit 26 is configured to decide, based on the control signal outputted by the reset detecting circuit 25, whether to output the reset signal XON to the gate drive circuit 102.

Figure 3:
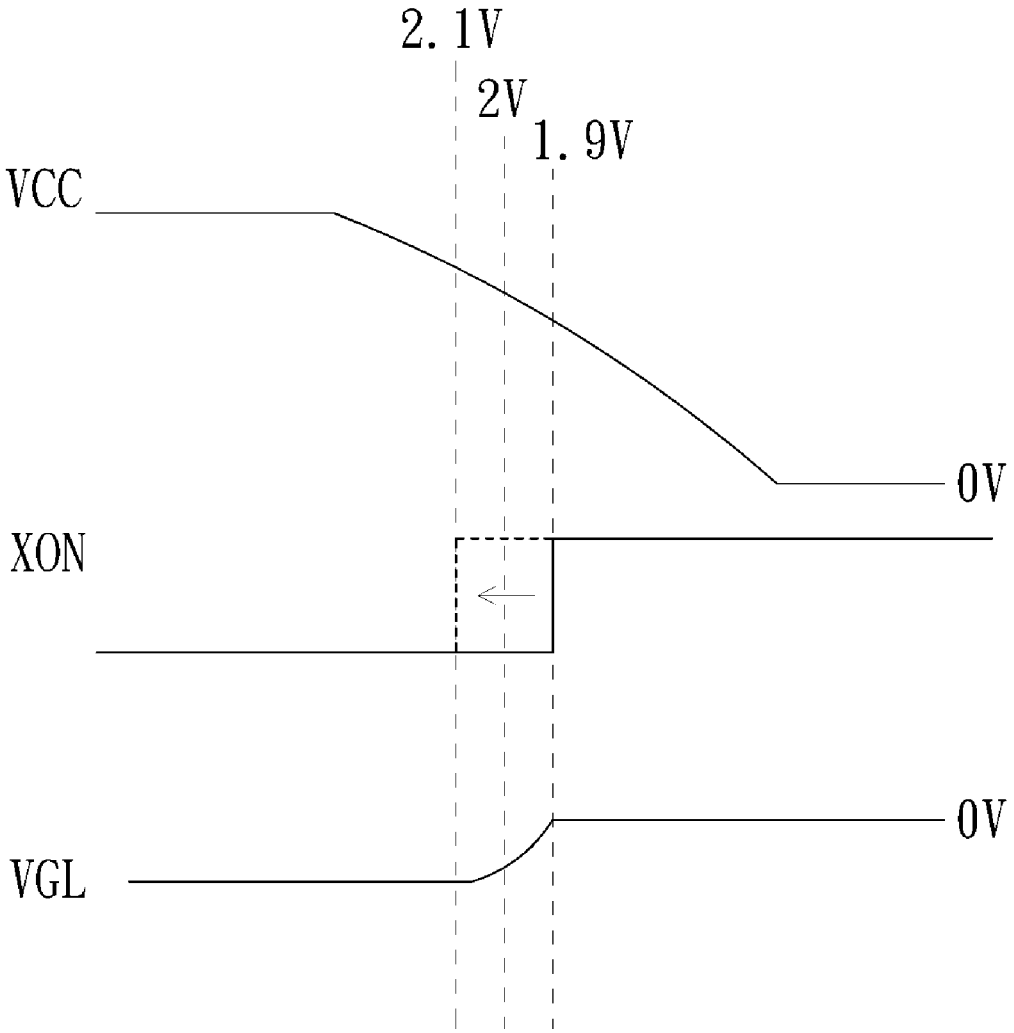
FIG. 3 is a signal-timing diagram according to one embodiment of the present disclosure.

FIG. 3 is a signal-timing diagram according to one embodiment of the present disclosure. In the following, the power supply circuit 200 in the present disclosure is described with references to the timing diagram illustrated in FIG. 3. Referring to both FIG. 2 and FIG. 3, assuming that the first preset value stored in the memory unit 21 is 2V, and the second preset value is 1.9 V. According to these two factory preset values, the power supply circuit 200 is therefore required to stop outputting the high voltage level VGH and low voltage level VGL when the operating voltage VCC drops to 2 V, and, ordinarily, the power supply circuit 200 would also output the reset signal XON to the gate drive circuit 102 when the operating voltage VCC drops to 1.9 V. However, because the power supply circuit 200 has already stopped outputting VGH and VGL when the operating voltage VCC drops to 1.9 V, a voltage difference between the operating voltage VCC and the low voltage level VGL becomes too small, and thus disrupting a normal operation of a level shifter LS in the gate drive circuit 102, and consequently no gate pulses could be outputted to the display panel 103.

Therefore, according to the invention, during the initialization of the display device when power on as shown in FIG. 2, the conversion circuit 22 reads the first preset value and second preset value stored in the memory unit 21, and convert the first preset value and second preset value to the voltages V1 and V2 respectively so that the comparison circuit 23 can perform a comparison. Because the comparison result outputted by the comparison circuit 23 shows that the first voltage V1 is greater than the second voltage V2, the preset value setting circuit 24 finds the third preset value, which is greater than the first preset value, in the look-up table based on the comparison result outputted by the comparison circuit 23, so that the reset threshold is adjusted from the second preset value to the third preset value. For example, the reset threshold is adjusted from the second preset value 1.9 V to a higher value of the third preset value, 2.1 V, and this third preset value is outputted as a reset threshold to the reset detecting circuit 25 to enable the reset detecting circuit 25 to operate accordingly. As a result, when the display device (shown in FIG. 2) powers off, the reset detecting circuit 25 outputs a control signal to control the reset signal generating circuit 26 to output the reset signal XON correspondingly once the reset detecting circuit 25 detects that the operating voltage VCC drops to the reset threshold of 2.1 V. Because the voltage difference between the operating voltage VCC and the low voltage level VGL at this time is still large enough to enable a normal operation of the level shifter LS in the gate drive circuit 102, the gate drive circuit 102 can output gate pulses without a problem to simultaneously drive the multiple gate lines G1-Gn in the display panel 103, and in turn releasing residual electric charges in the pixels of the display panel 103. According to another embodiment of the present disclosure, the display device shown in FIG. 2 may also perform the above initialization while performing a power-off procedure or a displaying procedure.

Naturally, if the comparison result outputted by the comparison circuit 23 indicates that the second preset value is greater than the first preset value, then the preset value setting circuit 24 directly outputs the second preset value as the reset threshold to the reset detecting circuit 25 to enable the reset detecting circuit 25 to perform an operation accordingly.

Figure 4:
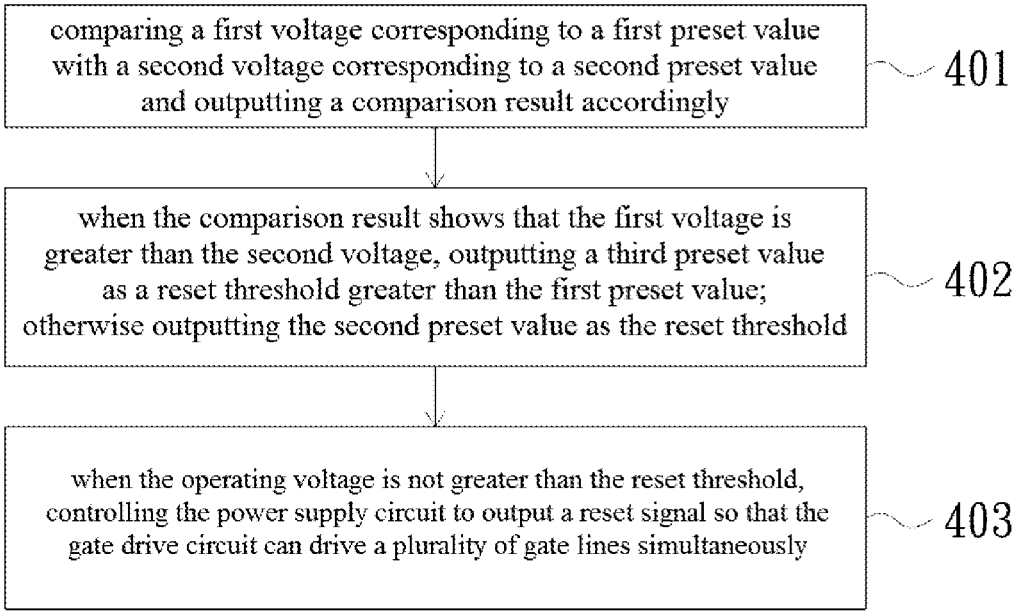
FIG. 4 is a flow chart of a driving method for a display panel according to one embodiment of the present disclosure.

FIG. 4 is a flow chart of a driving method for a display panel according to one embodiment of the present disclosure. As shown in FIG. 4, the driving method for a display panel according to the present embodiment is suitable for a display panel having multiple gate lines, and the driving method includes steps 401-403. Step 401: comparing a first voltage, corresponding to a first preset value, with a second voltage, corresponding to a second preset value, and outputting a comparison result. Step 402: when the comparison result shows that the first voltage is greater than the second voltage, outputting a third preset value as a reset threshold, which is greater than the first preset value; otherwise, outputting the second present value as the reset threshold. Step 403: when the operating voltage is not greater than the reset threshold, controlling the power supply circuit to output a reset signal to enable the gate drive circuit to simultaneously drive the multiple gate lines.

To sum up, the power supply circuit in the present disclosure adopts the comparison circuit to compare the first voltage and the second voltage, corresponding to the first preset value at which to stop VGH and VGL to the display and the second preset value at which to drive all gate lines to reset the display, and the preset value setting circuit can therefore adjust the second preset value to the third preset value, which is greater than the first preset value, when the first voltage is greater than the second voltage. In this way, when the display device powers off, the power supply circuit can output a reset signal to control the gate drive circuit to generate the gate pulses needed in advance when the operating voltage drops to the third preset value. Moreover, because a voltage difference between the operating voltage and the low voltage level at this time is large enough to enable a normal operation of a level shifter in the gate drive circuit, the gate drive circuit can generate the needed gate pulses without a problem so that the gate lines in the display panel can be reset simultaneously.

Even though the present disclosure has been disclosed via the above-mentioned preferred embodiments, the present disclosure is not to be limited thereto. Any person of ordinary skill in the art may make some changes and adjustments without departing from the spirit and scope of the present disclosure. Therefore, the scope of the present disclosure is defined in view of the appended claims.

The invention claimed is:

1. A power supply circuit, comprising:

a comparison circuit, for comparing a first operating voltage threshold with a second operating voltage threshold, wherein said power supply circuit receives an operating voltage, said power supply circuit stops outputting a high voltage level and a low voltage level to a gate drive circuit when said operating voltage drops to said first operating voltage threshold, and said power supply circuit outputs a reset signal when said operating voltage drops to said second operating voltage threshold;

a preset value setting circuit, for outputting a reset threshold, wherein said reset threshold is set to a third operating voltage threshold when said first operating voltage threshold is greater than said second operating voltage threshold, otherwise said reset threshold is set to said second operating voltage threshold, and said third operating voltage threshold is greater than said first operating voltage threshold;

a reset detecting circuit, for outputting a control signal when said operating voltage drops to said reset threshold; and a reset signal generating circuit, for outputting said reset signal to said gate drive circuit according to said control signal.

2. The power supply circuit of claim 1, wherein the preset value setting circuit further stores a look-up table recording the third operating voltage threshold.

3. The power supply circuit of claim 1, further comprising:

a memory unit, for storing the first operating voltage threshold and the second operating voltage threshold; and a conversion circuit, for reading the first operating voltage threshold and the second operating voltage threshold.

4. The power supply circuit of claim 1, wherein the preset value setting circuit outputs the second operating voltage threshold as the reset threshold when the first operating voltage threshold is less than the second operating voltage threshold.

5. A driving method, for a display panel comprising a plurality of gate lines, comprising:

comparing a first operating voltage threshold with a second operating voltage threshold, wherein a power supply circuit receives an operating voltage, the power supply circuit stops outputting a high voltage level and a low voltage level to a gate drive circuit when the operating voltage drops to the first operating voltage threshold, and the power supply circuit outputs a reset signal when said operating voltage drops to said second operating voltage threshold;

setting a reset threshold to be said second operating voltage threshold is said second operating voltage threshold is larger than said first operating voltage threshold, otherwise setting said reset threshold to be a third operating voltage threshold, wherein said third operating voltage threshold is larger than said first operating voltage threshold;

controlling the power supply circuit to output the reset signal to the gate drive circuit when the operating voltage is not greater than said reset threshold; and driving the gate lines simultaneously when said gate drive circuit receives said reset signal.

6. The driving method for a display panel of claim 5, further comprising:

looking up the third operating voltage threshold according to a look-up table.

7. The driving method for a display panel of claim 5, further comprising:

storing the first operating voltage threshold and the second operating voltage threshold;

reading the first operating voltage threshold and the second operating voltage threshold;

converting the first operating voltage threshold into the corresponding first voltage; and converting the second operating voltage threshold into the corresponding second voltage.

8. The driving method for a display panel of claim 5, further comprising:

outputting the second operating voltage threshold as the reset threshold when the first operating voltage threshold is less than the second operating voltage threshold.

* * * * *